US010495329B2

(12) United States Patent
Sawada

(10) Patent No.: US 10,495,329 B2
(45) Date of Patent: Dec. 3, 2019

(54) OUTDOOR UNIT OF AIR CONDITIONER

(71) Applicant: FUJITSU GENERAL LIMITED, Kawasaki-shi, Kanagawa-ken (JP)

(72) Inventor: Hirotaka Sawada, Kawasaki (JP)

(73) Assignee: FUJITSU GENERAL LIMITED, Kawasaki-Shi, Kanagawa (JP)

( * ) Notice: Subject to any disclaimer, the term of this patent is extended or adjusted under 35 U.S.C. 154(b) by 60 days.

(21) Appl. No.: 15/900,097

(22) Filed: Feb. 20, 2018

(65) Prior Publication Data

US 2018/0266707 A1 Sep. 20, 2018

(30) Foreign Application Priority Data

Mar. 15, 2017 (JP) ..... 2017-049400

(51) Int. Cl.
*F24F 1/38* (2011.01)
*F24F 13/08* (2006.01)

(52) U.S. Cl.
CPC ..... *F24F 1/38* (2013.01); *F24F 13/084* (2013.01); *F24F 2221/16* (2013.01)

(58) Field of Classification Search
CPC .... F24F 1/00; F24F 1/0003; F24F 1/06; F24F 1/08; F24F 1/10; F24F 1/12; F24F 1/14; F24F 1/16; F24F 1/18; F24F 1/38; F24F 1/40; F24F 1/48; F24F 1/50; F24F 1/56; F24F 13/00; F24F 13/08; F24F 13/082; F24F 13/084; F04D 29/563; F04D 29/622; F04D 29/644; F04D 29/646; F04D 29/703
USPC ..... 165/120, 121, 122, 125
See application file for complete search history.

(56) References Cited

U.S. PATENT DOCUMENTS 4,307,778 A * 12/1981 Tobin ..... F24F 1/18 165/125
4,899,647 A * 2/1990 Garries ..... E06B 7/02 454/277
7,300,248 B2 * 11/2007 Wang ..... F04D 25/088 248/343
8,092,156 B2 * 1/2012 Jang ..... F24F 1/38 415/121.2
8,137,059 B2 * 3/2012 Kim ..... F04D 29/703 415/119
9,212,845 B2 * 12/2015 Nakagawa ..... F24F 1/56
2011/0127019 A1 * 6/2011 Abastari ..... F24F 1/38 165/121

(Continued)

FOREIGN PATENT DOCUMENTS

JP 2010-127595 A 6/2010
JP 2010127595 A * 6/2010

OTHER PUBLICATIONS

Machine Translation JP 2010 127595A (Year: 2010).*

*Primary Examiner* — Keith M Raymond
*Assistant Examiner* — Gustavo A Hincapie Serna
(74) *Attorney, Agent, or Firm* — Manabu Kanesaka

(57) ABSTRACT

An outdoor unit of an air conditioner includes: a housing including a bottom surface, a side surface, and an upper surface; an outdoor heat exchanger arranged along the side surface of the housing; a blowing fan arranged on the upper surface of the housing; a bell mouth arranged around the blowing fan; a fan guard provided to cover an upper portion of the blowing fan; and a height changing member provided between the fan guard and the bell mouth and configured to change a height of the fan guard with respect to the blowing fan.

2 Claims, 10 Drawing Sheets

(56) References Cited

U.S. PATENT DOCUMENTS

| | | | | |
|---|---|---|---|---|
| 2018/0156475 | A1* | 6/2018 | Tadokoro | F24F 1/14 |
| 2018/0224135 | A1* | 8/2018 | Yamamoto | F24F 1/40 |
| 2018/0274800 | A1* | 9/2018 | Aoyama | F24F 1/50 |
| 2018/0283728 | A1* | 10/2018 | Li | F24F 13/06 |

* cited by examiner

OUTDOOR UNIT OF AIR CONDITIONER

CROSS-REFERENCE TO RELATED APPLICATION

This application claims priority from Japanese Patent Application No. 2017-049400 filed with the Japan Patent Office on Mar. 15, 2017, the entire content of which is hereby incorporated by reference.

BACKGROUND

1. Technical Field

The present disclosure relates to an outdoor unit of an air conditioner.

2. Description of the Related Art

An upward blow type outdoor unit is placed on a roof of a building, for example. An upward blow type outdoor unit 100 illustrated in FIG. 10 has a rectangular parallelepiped housing. The housing has a bottom surface 117, side surfaces, and an upper surface. An outdoor heat exchanger 111 is arranged along the side surfaces of the housing. A blowing fan 112 is arranged on the upper surface of the housing.

An axial fan (a radial fan) is used as the blowing fan 112. An air blowing direction of the blowing fan 112 is substantially perpendicular to the bottom surface 117 of the housing. The blowing fan 112 is placed on the upper surface of the housing. A bell mouth 113 is arranged around the blowing fan 112. The bell mouth 113 is configured to adjust and stabilize an air flow. The bell mouth 113 is provided with a fan guard 114 such that the fan guard 114 covers an upper portion of the blowing fan 112.

In this outdoor unit 100, when the blowing fan 112 is in operation, ambient air is sucked into the housing through the side surface of the housing while heat is being exchanged between the ambient air and refrigerant at the outdoor heat exchanger 111. Thereafter, the air is blown from the upper surface of the housing (see, e.g., JP-A-2010-127595).

In many cases, the upward blow type outdoor unit is placed on the roof of the building. The outdoor unit is normally delivered to the roof of the building by a freight elevator. The freight elevator has restriction on the size of goods to be delivered. For this reason, the packing size of the outdoor unit needs to be a size (specifically, a height) placeable on the freight elevator.

Considering the thickness of a pallet for delivery by a forklift and a clearance upon lifting of the outdoor unit in the elevator by way of example, predetermined restriction is placed on the packing size (specifically, the height) of the outdoor unit.

For preventing contact of an air current, a distance d1 between the outdoor heat exchanger 111 and the blowing fan 112 and a distance d2 between the blowing fan 112 and the fan guard 114 are preferably long in the upward blow type outdoor unit.

However, the height of the outdoor unit is restricted by the above-described packing size. For this reason, it is difficult to increase the distance d1 between the outdoor heat exchanger 111 and the blowing fan 112 and the distance d2 between the blowing fan 112 and the fan guard 114. Thus, contact of the air current is easily caused.

SUMMARY

An outdoor unit of an air conditioner includes: a housing including a bottom surface, a side surface, and an upper surface; an outdoor heat exchanger arranged along the side surface of the housing; a blowing fan arranged on the upper surface of the housing; a bell mouth arranged around the blowing fan; a fan guard provided to cover an upper portion of the blowing fan; and a height changing member provided between the fan guard and the bell mouth and configured to change a height of the fan guard with respect to the blowing fan.

DESCRIPTION OF THE EMBODIMENTS

Figure 1:
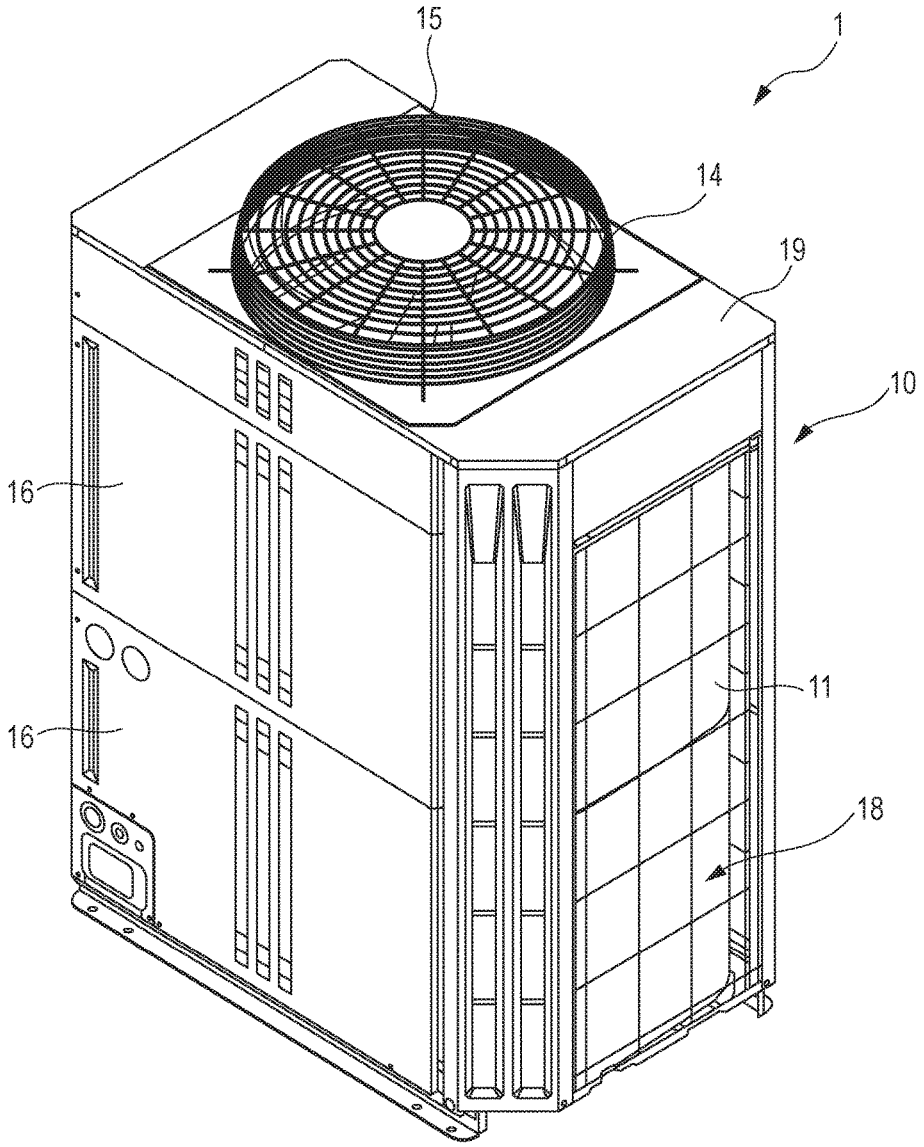
FIG. 1 is a perspective view of an outer appearance of an outdoor unit of an air conditioner according to one embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

An object of the present disclosure is to provide an upward blow type outdoor unit in an air conditioner, the outdoor unit being configured so that the height of the outdoor unit can be decreased upon delivery to an installation location and can be, after delivery, increased back at the installation location to improve performance.

An outdoor unit of an air conditioner according to one aspect of the present disclosure (the present outdoor unit) includes: a housing including a bottom surface, a side surface, and an upper surface; an outdoor heat exchanger arranged along the side surface of the housing; a blowing fan arranged on the upper surface of the housing; a bell mouth arranged around the blowing fan; a fan guard provided to cover an upper portion of the blowing fan; and a height changing member provided between the fan guard and the bell mouth and configured to change a height of the fan guard with respect to the blowing fan.

According to a preferred embodiment of the present outdoor unit, the fan guard includes a support frame to be fitted onto the bell mouth, the height changing member includes multiple first raised portions formed at a predetermined interval along a circumferential direction of the bell mouth on a side surface of the bell mouth, and second raised portions formed to protrude downward from a lower side of the support frame and formed at an interval substantially equal to that of the first raised portions along a circumferential direction of the support frame, and the first raised portions and the second raised portions are configured such that each second raised portion is arranged between adjacent ones of the first raised portions or arranged on a corresponding one of the first raised portions.

According to another embodiment of the present outdoor unit, each first raised portion may include a first slope as a rising slope along the circumferential direction of the bell mouth from a second side of another one of the first raised portions adjacent to a first side of the each first raised portion, each second raised portion may include a second slope as a slope parallel with the first slope, and the first raised portions and the second raised portions may be configured such that each second raised portion is, in association with rotation of the fan guard, guided by the first slope and the second slope to move onto a corresponding one of the first raised portions.

According to the outdoor unit of the present disclosure, the support frame to be fitted in the bell mouth is attached to the fan guard. Further, the height changing member configured to change the height of the fan guard with respect to the blowing fan is provided between the bell mouth and the support frame. With this configuration, the fan guard is, upon delivery (shipment) of the present outdoor unit, moved closer to the blowing fan so that the height of the present outdoor unit can be decreased. Further, upon installation of the present outdoor unit after delivery, the fan guard is moved in a direction apart from the blowing fan so that the fan guard can be separated from the blowing fan to increase a distance between these components. With this configuration, contact of an air current can be reduced.

First Embodiment

An embodiment of the present disclosure will be described with reference to the drawings. Note that the technique of the present disclosure is not limited to such an embodiment.

As illustrated in FIG. 1, an outdoor unit 1 of an air conditioner according to this embodiment includes a substantially rectangular parallelepiped housing 10. The housing 10 includes a bottom surface 17, side surfaces 18, and an upper surface 19. An outdoor heat exchanger 11 is arranged along three of the four side surfaces 18 of the housing 10. Two upper and lower service panels 16 are provided at the remaining side surface 18. The service panels 16 are opened/closed upon maintenance of the inside of the housing 10. The service panels 16 are optional components.

Figure 2A:
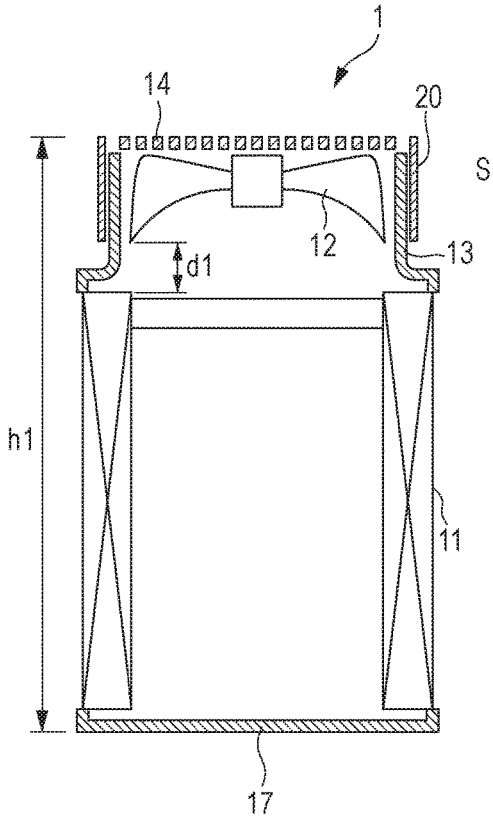
FIG. 2A is a schematic view of the outdoor unit whose height is decreased upon delivery.
Figure 2B:
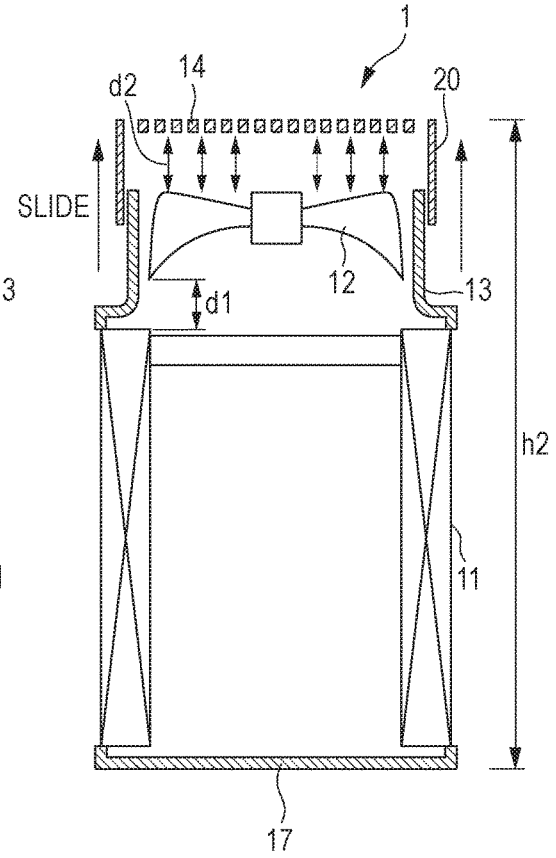
FIG. 2B is a schematic view of the outdoor unit whose height is increased at an installation location.

The upper surface 19 of the housing 10 is provided with an air outlet 15. Referring to FIGS. 1, 2A, and 2B, a blowing fan 12 as an axial fan is placed in the air outlet 15 such that an air blowing direction thereof is substantially perpendicular to the bottom surface 17.

A bell mouth 13 is arranged coaxially with the blowing fan 12 around the blowing fan 12. The bell mouth 13 is configured to adjust and stabilize an air flow. The bell mouth 13 is provided with a fan guard 14 such that the fan guard 14 covers an upper portion of the blowing fan 12. The height of the outdoor unit 1 is a dimension from the bottom surface 17 (a bottom plate of the bottom surface 17) to the fan guard 14. Note that the housing 10 may be in a cylindrical shape.

In the present embodiment, the size of the outdoor unit 1 is a packing size upon delivery (factory shipment). That is, the fan guard 14 is moved closer to the blowing fan 12 as illustrated in FIG. 2A. Accordingly, the height of the outdoor unit 1 reaches a smaller height h1. On the other hand, the fan guard 14 is, at an installation location, moved apart from the blowing fan 12 as illustrated in FIG. 2B. Accordingly, the height of the outdoor unit 1 can reach a greater height h2.

Figure 3A:
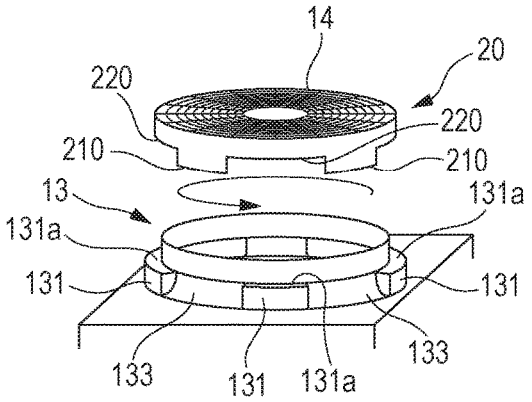
FIG. 3A is an exploded perspective view of a height changing member applied to the outdoor unit in the first embodiment.
Figure 3B:
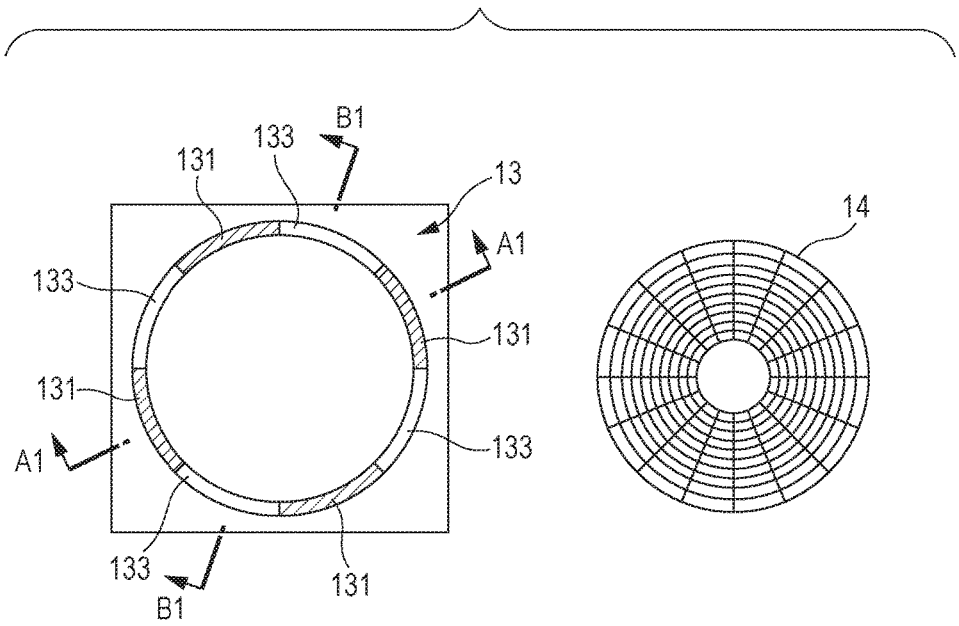
FIG. 3B is a schematic view of an upper surface of a bell mouth with a fan guard being detached.

In the present embodiment, the fan guard 14 includes, at a peripheral edge thereof, a support frame 20 as illustrated in FIGS. 3A and 3B. The support frame 20 has a skirt shape. The support frame 20 is attached to the bell mouth 13 with the support frame 20 being rotatable relative to the bell mouth 13 and being movable in an axial direction of the bell mouth 13. The support frame 20 is preferably fitted onto an outer peripheral side of the bell mouth 13. The bell mouth 13 and the support frame 20 may be made of metal or synthetic resin, for example.

A height changing member is provided between the bell mouth 13 and the support frame 20. The height changing member is configured to change the height of the fan guard 14 with respect to the blowing fan 12.

The height changing member of the present embodiment includes a combination of raised portions 131 provided on a side surface (an outer peripheral surface) of the bell mouth 13 and raised portions 210 provided at the support frame 20. For the sake of convenience of description, the raised portion 131 on a bell mouth 13 side will be referred to as a "first raised portion 131," and the raised portion 210 on a support frame 20 side will be referred to as a "second raised portion 210."

The first raised portions 131 are arranged at multiple points of the side surface of the bell mouth 13. In an illustrated example, the first raised portions 131 are arranged at four points of the side surface of the bell mouth 13 at a center angle interval of 90°. A recessed portion (a first recessed portion) 133 is relatively formed between adjacent ones of the first raised portions 131.

Figure 4A:
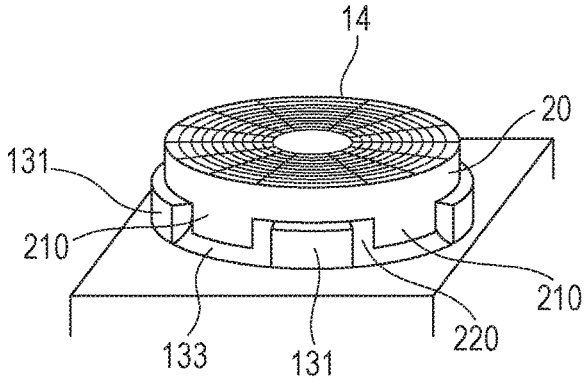
FIG. 4A is a schematic view of the outdoor unit whose height is decreased upon delivery in the first embodiment.
Figure 4B:
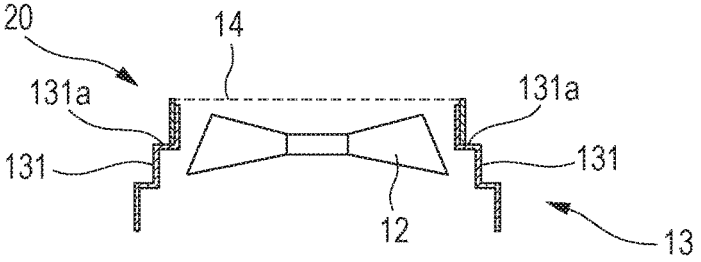
FIG. 4B is a sectional view along line A1-A1 of FIG. 3B.

The first raised portion 131 is formed in such a manner that a portion of a peripheral wall of the bell mouth 13 projects outward in a radial direction (see FIG. 4B). An upper surface 131*a* of the first raised portion 131 is a flat surface substantially parallel with the bottom surface 17.

The second raised portions 210 on the support frame 20 side are arranged at multiple points of a lower side of the support frame 20. In the illustrated example, the second raised portions 210 are arranged at four points of the lower side of the support frame 20 at a center angle interval of 90°. A recessed portion (a second recessed portion) 220 is relatively formed between adjacent ones of the second raised portions 210.

In this embodiment, the length (the width) of the first raised portion 131 along a circumferential direction of the bell mouth 13 is substantially ⅛ (the substantially ⅛ perimeter) of the length of the circumference of the bell mouth 13. Thus, the length (the width) of the first recessed portion 133 along the circumferential direction of the bell mouth 13 is also a substantially ⅛ perimeter.

On the other hand, the length (the width) of the second raised portion 210 along a circumferential direction of the support frame 20 may be substantially ⅛ (the substantially ⅛ perimeter) of the length of the circumference of the support frame 20, but is preferably shorter than the ⅛ perimeter. Thus, the length (the width) of the second recessed portion 220 along the circumferential direction of the support frame 20 is relatively the substantially ⅛ perimeter or longer.

Figure 4C:
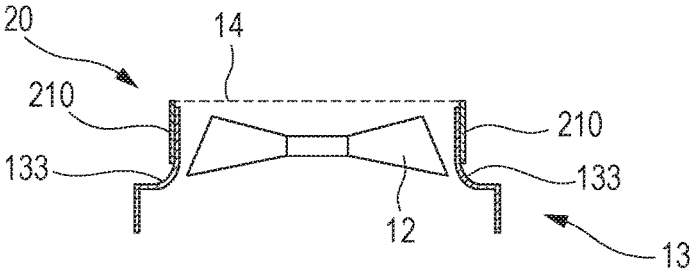
FIG. 4C is a sectional view along line B1-B1 of FIG. 3B.

As illustrated in FIGS. 4A to 4C, the second raised portions 210 of the support frame 20 are each fitted in the first recessed portions 133 of the bell mouth 13. Further, the first raised portions 131 of the bell mouth 13 are each fitted in the second recessed portions 220 of the support frame 20. Accordingly, the height of the outdoor unit 1 reaches the height h1 as the packing size upon delivery (factory shipment) as illustrated in FIG. 2A. That is, the fan guard 14 is moved closer to the blowing fan 12 so that the height of the outdoor unit 1 can reach the smaller height h1.

Figure 5A:
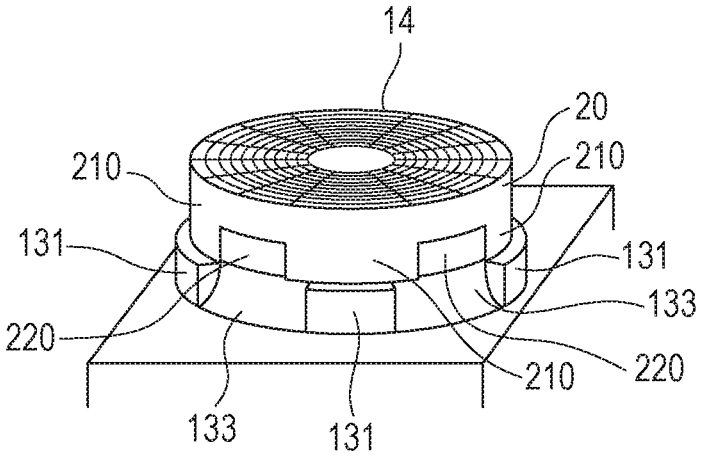
FIG. 5A is a schematic view of the outdoor unit whose height is increased at the installation location in the first embodiment.
Figure 5B:
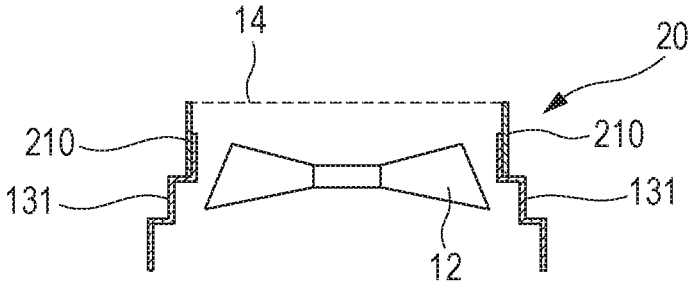
FIG. 5B is a sectional view along line A1-A 1 of FIG. 3B.
Figure 5C:
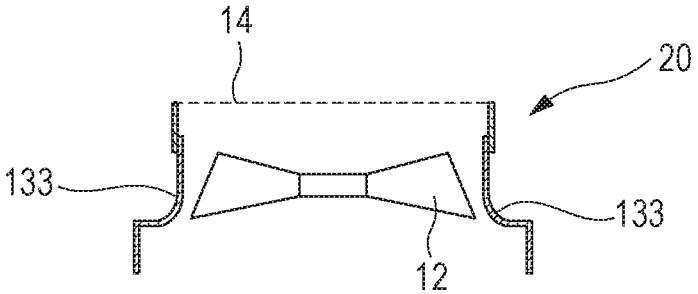
FIG. 5C is a sectional view along line B1-B1 of FIG. 3B.

When the support frame 20 is lifted and rotated substantially 45° from this state, the second raised portions 210 of the support frame 20 are each placed on the upper surfaces 131*a* of the first raised portions 131 of the bell mouth 13 as illustrated in FIGS. 5A to 5C. Accordingly, the height of the outdoor unit 1 reaches the height h2 at the installation location (a delivery destination) as illustrated in FIG. 2B. That is, the fan guard 14 is, upon installation of the outdoor unit 1, moved apart from the blowing fan 12 so that the height of the outdoor unit 1 can reach the greater height h2.

As described above, in the present embodiment, the first raised portions 131 and the second raised portions 210 are configured such that each second raised portion 210 is arranged between adjacent ones of the first raised portions 131 or arranged on a corresponding one of the first raised portions 131. Thus, according to the present embodiment, when the height of the outdoor unit 1 is changed to the height as the packing size upon delivery, the fan guard 14 can be moved closer to the blowing fan 12. With this configuration, even when the height of the outdoor unit 1 is decreased as illustrated in FIG. 2A, a distance d1 between the outdoor heat exchanger 11 and the blowing fan 12 can be increased (i.e., a long distance can be maintained).

On the other hand, when the outdoor unit 1 is placed at the installation location (the delivery destination), the fan guard 14 can be moved apart from the blowing fan 12. With this configuration, a distance d2 between the blowing fan 12 and the fan guard 14 can be increased as illustrated in FIG. 2B, and therefore, performance of the outdoor unit can be improved. Note that when the distance d2 is increased only by about 5 cm by way of example, it can be expected that contact of an air current is reduced and performance of the outdoor unit is improved.

Note that the length (the width) of each of the first raised portions 131, the first recessed portions 133, the second raised portions 210, and the second recessed portions 220 along the circumferential direction may be such a length that fitting between the first raised portion 131 and the second recessed portion 220 and fitting between the second raised portion 210 and the first recessed portion 133 can be simultaneously made. Moreover, the first raised portions 131 may be provided at at least two points of the side surface of the bell mouth 13 at a center angle interval of 180°. Further, the second raised portions 210 may be provided at at least two points of the lower side of the support frame 20 at a center angle interval of 180°.

In addition, in a case where the fan guard 14 is attached to the outdoor unit 1 at the installation location, the support frame 20 is preferably fixed to the bell mouth 13 for reducing noise such as chattering noise due to vibration of the support frame 20. Two examples of this case will be described with reference to FIGS. 6A and 6B.

Figure 6A:
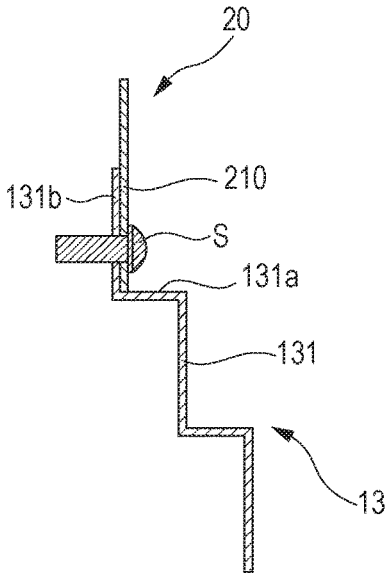
FIG. 6A is a sectional view of a first example of screwing of the fan guard to the bell mouth.

In the first example, the second raised portion 210 of the support frame 20 is screwed to an upper edge portion 131*b* of the bell mouth 13 with an external thread S as illustrated in FIG. 6A.

Figure 6B:
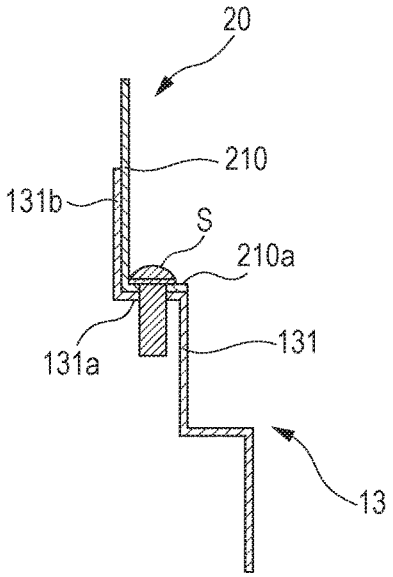
FIG. 6B is a sectional view of a second example.

In the second example, a lower end of the second raised portion 210 of the support frame 20 is bent in an L-shape as illustrated in FIG. 6B. Thus, a flange 210*a* facing the upper surface 131*a* of the first raised portion 131 is formed. The flange 210*a* is screwed to the upper surface 131*a* of the first raised portion 131 with an external thread S.

In comparison between these two examples, a tip end of the external thread S protrudes closer to a blade of the blowing fan 12 in the bell mouth 13 in the case of the first example. For this reason, the second example is more preferable.

Second Embodiment

Next, a second embodiment will be described with reference to FIGS. 7A, 7B, 8A, 8B, 9A, and 9B. In the second embodiment, a fan guard 14 is rotated relative to a bell mouth 13 in a predetermined direction so that the fan guard 14 can be moved in a direction apart from a blowing fan 12.

Figure 7A:
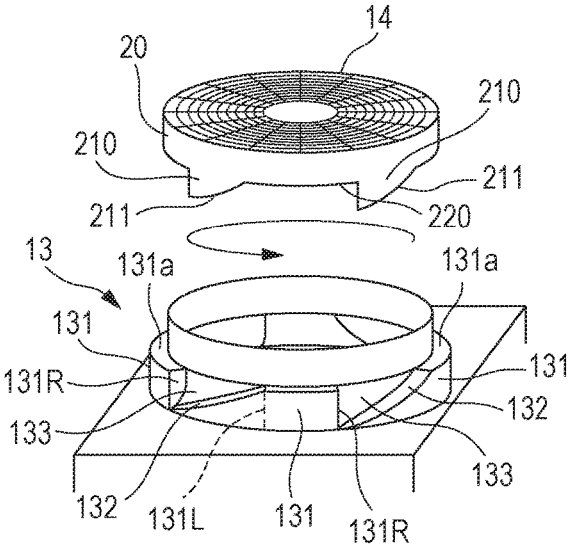
FIG. 7A is an exploded perspective view of a height changing member applied to an outdoor unit in a second embodiment.
Figure 7B:
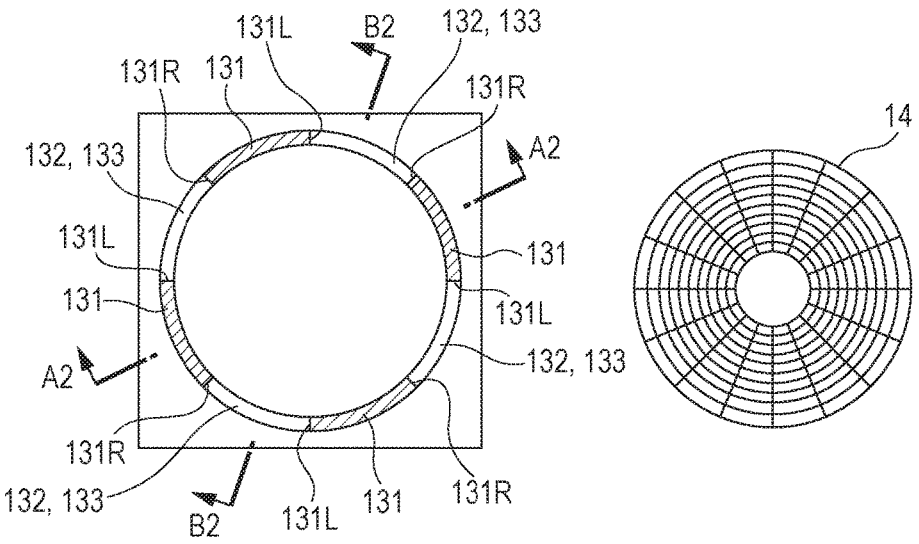
FIG. 7B is a schematic view of an upper surface of a bell mouth with a fan guard being detached.

As illustrated in FIG. 7A, the bell mouth 13 is also provided with multiple first raised portions 131 in the second embodiment. Note that each first raised portion 131 is formed in a ratchet gear shape.

That is, a first slope 132 is formed between a top portion of a first side 131L (the left side in FIG. 7A) of each first raised portion 131 and a bottom portion of a second side 131R (the right side in FIG. 7A) of the first raised portion 131 adjacent to the first side 131L. The first slope 132 is a rising slope along a circumferential direction (counterclockwise in FIG. 7A) of the bell mouth 13.

With this configuration, a first recessed portion 133 is in a right-angled triangular shape having, as two sides thereof, the side 131R of the first raised portion 131 and the first slope 132 and opening on an upper side. Note that the first slope 132 may be a slope starting from a point apart from the bottom portion of the side 131R of the first raised portion 131.

Moreover, a second slope 211 as a slope parallel (or substantially parallel) with the first slope 132 is also provided on a lower side of each second raised portion 210 of a support frame 20.

Figure 8A:
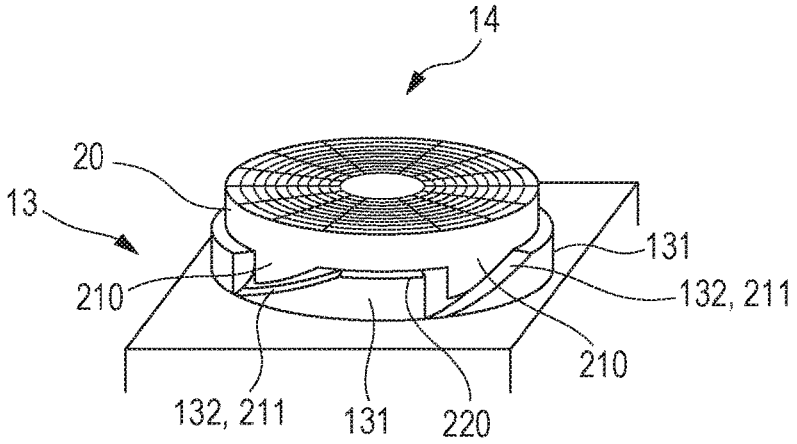
FIG. 8A is a schematic view of the outdoor unit whose height is decreased upon delivery in the second embodiment.
Figure 8B:
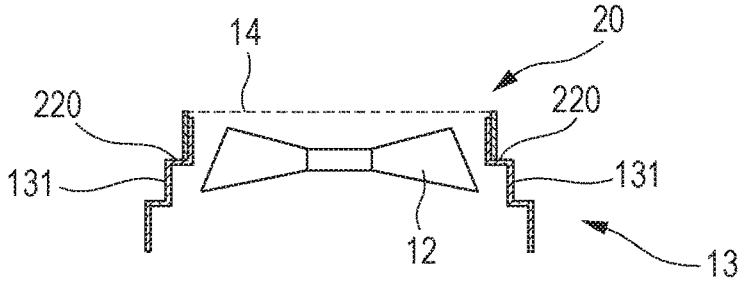
FIG. 8B is a sectional view along line A2-A2 of FIG. 7B.
Figure 8C:
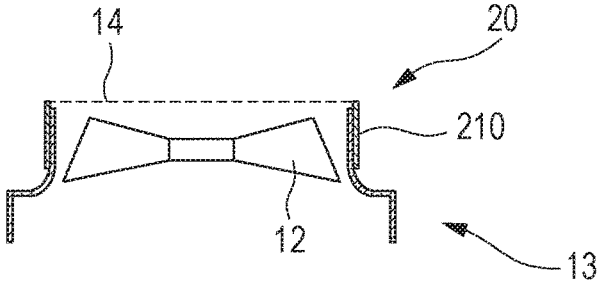
FIG. 8C is a sectional view along line B2-B2 of FIG. 7B.

According to the second embodiment, as illustrated in FIG. 8A, the second raised portions 210 are each fitted in the first recessed portions 133 such that the second slopes 211 each contact the first slopes 132. With this configuration, the height of an outdoor unit 1 reaches a height h1 as a packing size upon delivery (factory shipment) as illustrated in FIG. 2A. That is, the fan guard 14 is moved closer to the blowing fan 12 so that the height of the outdoor unit 1 can reach the smaller height h1.

Figure 9A:
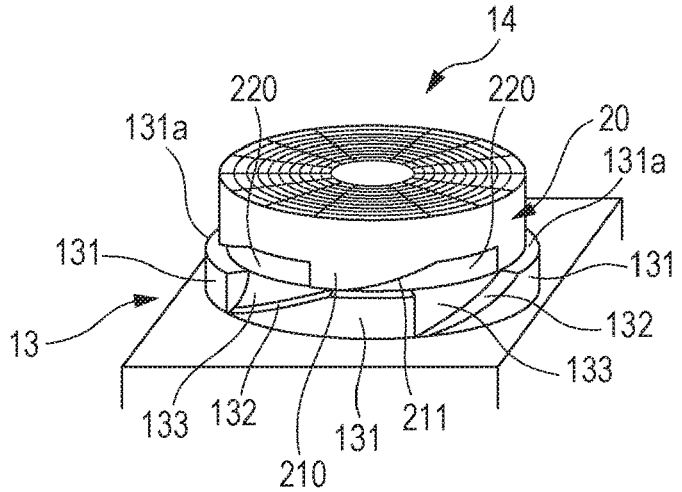
FIG. 9A is a schematic view of the outdoor unit whose height is increased at an installation location in the second embodiment.
Figure 9B:
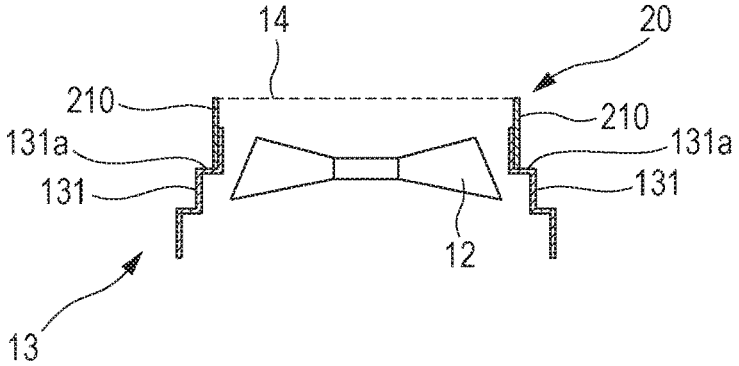
FIG. 9B is a sectional view along line A2-A2 of FIG. 7B.
Figure 9C:
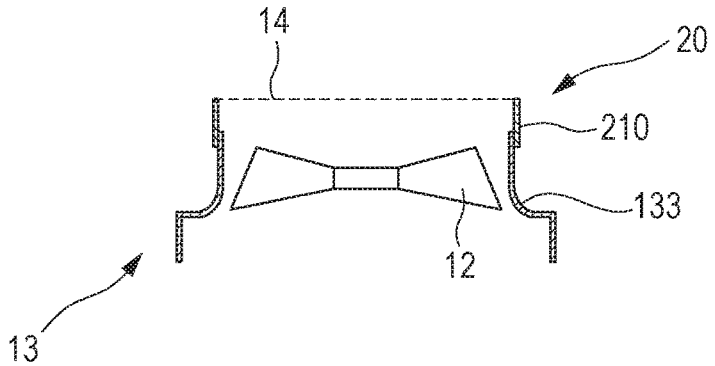
FIG. 9C is a sectional view along line B2-B2 of FIG. 7B.
Figure 10:
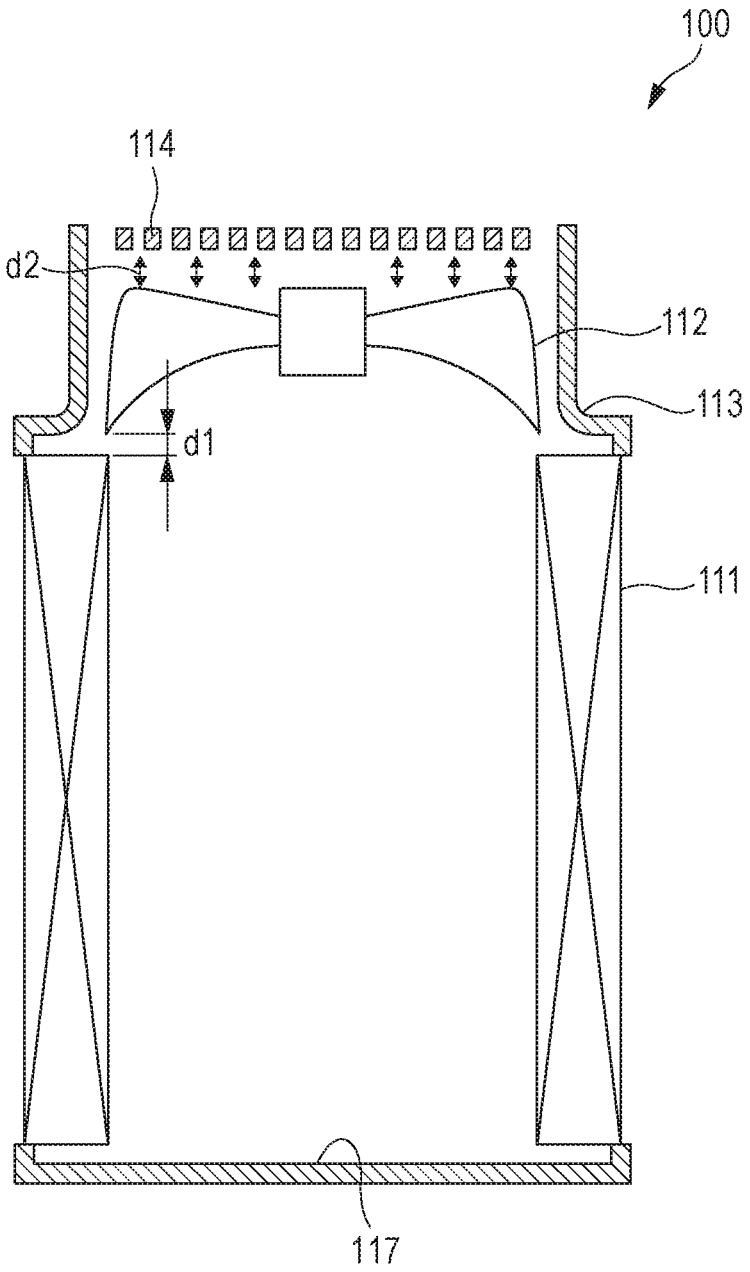
FIG. 10 is a schematic view of a typical outdoor unit in a packing size with a decreased height.

The support frame 20 is rotated in a predetermined direction (a counterclockwise direction in FIG. 8A) from this state. Accordingly, each second raised portion 210 is guided by a corresponding one of the first slopes 132 and a corresponding one of the second slopes 211, and therefore, moves over an upper surface 131*a* of a corresponding one of the first raised portion 131 as illustrated in FIG. 9A. Thus, the height of the outdoor unit 1 reaches a height h2 at an installation location (a delivery destination) as illustrated in FIG. 2B. That is, the fan guard 14 is, upon installation of the outdoor unit 1, moved apart from the blowing fan 12 as illustrated in FIG. 2B so that the height of the outdoor unit 1 can reach the greater height h2.

As described above, in the present embodiment, the first raised portions 131 and the second raised portions 210 are configured such that each second raised portion 210 is, in association with rotation of the fan guard 14, guided by a corresponding one of the first slopes 132 and a corresponding one of the second slopes 211 to move onto a corresponding one of the first raised portions 131.

As described above, according to the embodiments of the present disclosure, the fan guard 14 is moved closer to the blowing fan 12 so that the height of the outdoor unit 1 can be decreased. With this configuration, the outdoor unit 1 can be delivered with the fan guard 14 being attached to the bell mouth 13. Thus, the outdoor unit 1 is in the packing size upon delivery of the outdoor unit 1, and therefore, it is not necessary to detach the fan guard 14 from the bell mouth 13 to decrease the height of the outdoor unit 1 and to attach the fan guard 14 after on-site installation of the outdoor unit 1.

The embodiments of the present disclosure may be the following first to third outdoor units.

The first outdoor unit is an outdoor unit of an air conditioner which includes a housing having a bottom surface, side surfaces, an upper surface and which is configured such that an outdoor heat exchanger is arranged along the side surfaces of the housing, that a blowing fan is arranged on the upper surface of the housing, that a bell mouth is arranged around the blowing fan, and that a fan guard is provided to cover an upper portion of the blowing fan. In this outdoor unit, a height changing member configured to change the height of the fan guard with respect to the blowing fan is provided between the fan guard and the bell mouth.

The second outdoor unit is the first outdoor unit in which the fan guard includes a support frame to be fitted onto the bell mouth, the height changing member includes multiple first raised portions formed at a predetermined interval along a circumferential direction of the bell mouth on a side surface of the bell mouth, and second raised portions formed to protrude downward from a lower side of the support frame and formed at an interval substantially equal to that of the first raised portions along a circumferential direction of the support frame, and the height of the fan guard is different between arrangement of each second raised portion between adjacent ones of the first raised portions and arrangement of each second raised portion on a corresponding one of the first raised portions.

The third outdoor unit is the second outdoor unit in which each first raised portion includes a first slope as a rising slope along the circumferential direction from one side of another one of the first raised portions adjacent to the other side of the each first raised portion, each second raised portion includes a second slope as a slope parallel with the first slope, and each second raised portion is, in association with rotation of the fan guard, guided by the first and second slopes to move onto a corresponding one of the first raised portions.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An outdoor unit of an air conditioner, comprising:

a housing including a bottom surface, a side surface, and an upper surface;

an outdoor heat exchanger arranged along the side surface of the housing;

a blowing fan arranged on the upper surface of the housing;

a bell mouth arranged around the blowing fan;

a fan guard provided to cover an upper portion of the blowing fan; and a height changing member configured to change a height of the fan guard with respect to the blowing fan, wherein the fan guard includes a support frame to be fitted onto the bell mouth, the height changing member includes multiple first raised portions formed at a predetermined interval along a circumferential direction of the bell mouth on a side surface of the bell mouth, and second raised portions formed to protrude downward from a lower side of the support frame and formed at an interval equal to that of the first raised portions along a circumferential direction of the support frame, and the first raised portions and the second raised portions are configured such that each second raised portion is arranged between adjacent ones of the first raised portions or arranged on a corresponding one of the first raised portions.

2. An outdoor unit of an air conditioner, comprising:

a housing including a bottom surface, a side surface, and an upper surface;

an outdoor heat exchanger arranged along the side surface of the housing;

a blowing fan arranged on the upper surface of the housing;

a bell mouth arranged around the blowing fan;

a fan guard provided to cover an upper portion of the blowing fan; and a height changing member configured to change a height of the fan guard with respect to the blowing fan, wherein the fan guard includes a support frame to be fitted onto the bell mouth, the height changing member includes multiple first raised portions formed at a predetermined interval along a circumferential direction of the bell mouth on a side surface of the bell mouth, and second raised portions formed to protrude downward from a lower side of the support frame and formed at an interval equal to that of the first raised portions along a circumferential direction of the support frame, the first raised portions and the second raised portions are configured such that each second raised portion is arranged between adjacent ones of the first raised portions or arranged on a corresponding one of the first raised portions, each first raised portion includes a first slope as a rising slope along the circumferential direction of the bell mouth from a second side of another one of the first raised portions adjacent to a first side of the each first raised portion, each second raised portion includes a second slope as a slope parallel with the first slope, and the first raised portions and the second raised portions are configured such that each second raised portion is, in association with rotation of the fan guard, guided by the first slope and the second slope to move onto a corresponding one of the first raised portions.

* * * * *